United States Patent [19]

DeAngelis

[11] 3,945,043

[45] Mar. 23, 1976

[54] FLIP-UP VISOR ASSEMBLY FOR HELMET

[75] Inventor: Armand DeAngelis, Southbridge, Mass.

[73] Assignee: Omnitech Inc., Southbridge, Mass.

[22] Filed: Dec. 17, 1974

[21] Appl. No.: 533,705

[52] U.S. Cl. ..... 2/8
[51] Int. Cl.[2] ..... A61F 9/06
[58] Field of Search ..... 2/10, 9, 8, 7, 6, 3 R

[56] References Cited

UNITED STATES PATENTS

| | | | |
|---|---|---|---|
| 1,601,830 | 10/1926 | Huntsman | 2/8 |
| 2,105,028 | 1/1938 | Dickhoff | 2/3 R |
| 2,461,604 | 2/1949 | Huntsman | 2/8 |
| 3,067,426 | 12/1962 | Tompkins | 2/9 X |
| 3,797,041 | 3/1974 | Raschke | 2/8 |

*Primary Examiner*—Alfred R. Guest
*Attorney, Agent, or Firm*—Shenier & O'Connor

[57] ABSTRACT

A flip-up visor assembly for a protective sport helmet or the like, in which a band secured at spaced points along the length and intermediate the ends thereof across the brow portion of a helmet with resilient pads disposed between the free band ends and the outer surface of the helmet to accommodate a range of helmet sizes carries adjacent its ends a pair of pivot pins which pivotally support the visor lens frame for movement between a position at which the visor lens is in front of the upper portion of the wearer's face and a position over the helmet at which the lens is clear of the wearer's face. Associated with the pivot pins are interengageable positive stop means for limiting the movement of the frame between its two extreme limit positions and spring loaded detent means for releasable retaining the visor in its limit positions and in spaced positions intermediate its limit positions. The arrangement is such that the visor can be moved to any of its positions manually by a force exerted on the visor itself, without requiring manipulation of any knobs or positive locking means or the like. Means is provided for for manually releasably assembling the lens visor in the visor frame.

15 Claims, 10 Drawing Figures

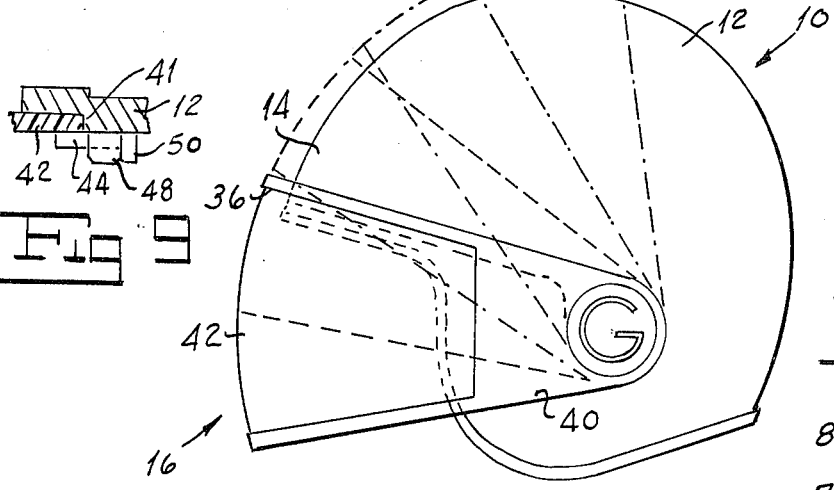
Fig 1
Fig 9
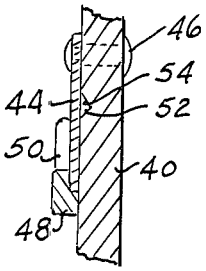
Fig 10
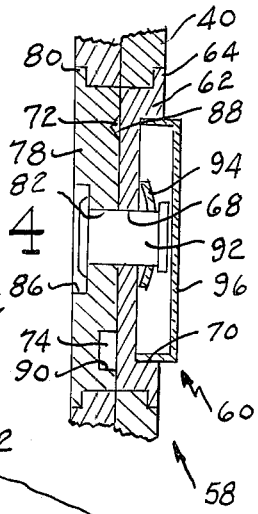
Fig 4
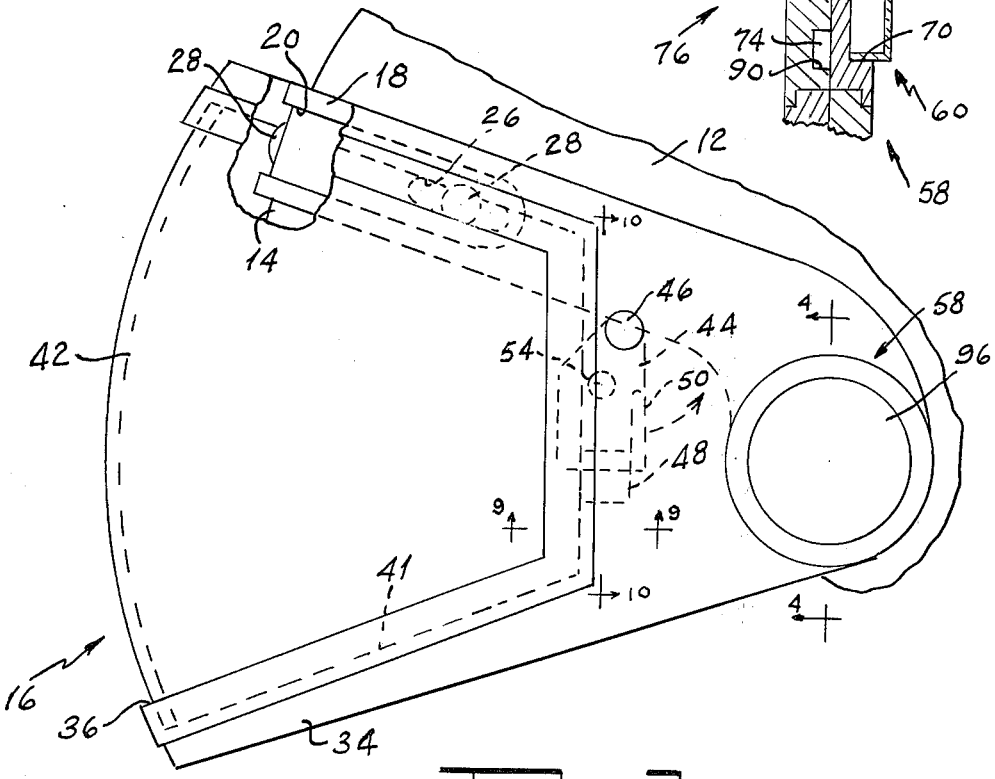
Fig 2

FLIP-UP VISOR ASSEMBLY FOR HELMET

BACKGROUND OF THE INVENTION

Various forms of protective helmet and visor assemblies are known in the prior art. Visor assemblies associated with protective helmets of the prior art incorporate actutable means, such as knobs or the like which must be manipulated to release locking elements and the like associated with the visor to permit it to move between its limit positions. While being secure as is necessary for military applications and the like, the assemblies are relatively inconvenient to use. Owing to their construction they are, moreover, relatively expensive. In addition, the visor assemblies of the prior art are such that each assembly is tailored to the size of helmet for which it is intended. Stated otherwise, no one assembly of the prior art will readily accommodate a range of helmet sizes.

I have invented a visor assembly for helmets which overcomes defects of visor assemblies of the prior art. My assembly is adapted to accommodate a range of helmet sizes. It is readily manually moveable among a plurality of positions with relation to the helmet in response to a force exerted on the assembly itself. It does not require the manipulation of auxiliary levers or knobs or the like to release locking means. It is relatively simple in construction. It is inexpensive.

SUMMARY OF THE INVENTION

One object of my invention is to provide a flip-up visor assembly for a helmet.

Another object of my invention is to provide a flip-up visor assembly for a helmet which can be raised and lowered in response to a force exerted on the visor itself without requiring the manipulation of lock releasing knobs or the like.

A further object of my invention is to provide a flip-up visor assembly for helmets which accommodates a wide range of helmet sizes.

A further object of my invention is to provide a flip-up visor assembly for a helmet which is relatively simple in construction.

Still another object of my invention is to provide a flip-up visor assembly for a helmet which is inexpensive.

Other and further objects of my invention will appear from the following description.

In general, my invention contemplates the provision of a flip-up visor assembly for a helmet, in which a band secured across the brow portion of the helmet at spaced locations along its length and intermediate its ends carries adjacent to the ends thereof pivot pins which support the visor lens frame for movement between a position at which the visor is substantially entirely in front of the wearer's face and another position at which the visor is above the helmet and clear of the wearer's face. Associated with each of the pivots I provide positively engaging means for limiting the movement of the visor frame to its two extreme positions and spring loaded detent means for releasably retaining the visor in its limit positions and in spaced positions intermediate the limit positions while permitting the visor to be moved among its various positions in response to a force exerted on the visor itself without the manipulation of auxiliary lock releasing knobs and the like. I provide my assembly with means for releasably retaining the lens in the lens frame.

BRIEF DESCRIPTION OF THE DRAWINGS

In the accompanying drawings which reference is made in the instant specification and in which liked reference character are used to indicate like parts in the various views:

FIG. 1 is a side elevation of a helmet provided with my flip-up visor assembly.

FIG. 2 is a fragmentary side elevation of a helmet to which my flip-up visor assembly is attached.

FIG. 4 is a fragmentary sectional view of my flip-up visor assembly for helmet taken along the line 4—4 of FIG. 2 and drawn on an enlarged scale.

FIG. 9 is a fragmentary sectional view of my flip-up visor assembly for a helmet taken along the line 9—9 of FIG. 2.

FIG. 10 is a fragmentary sectional view of my flip-up visor assembly for a helmet taken along the line 10—10 of FIG. 2.

DESCRIPTION OF THE PREFERRED EMBODIMENT

Figure 3:
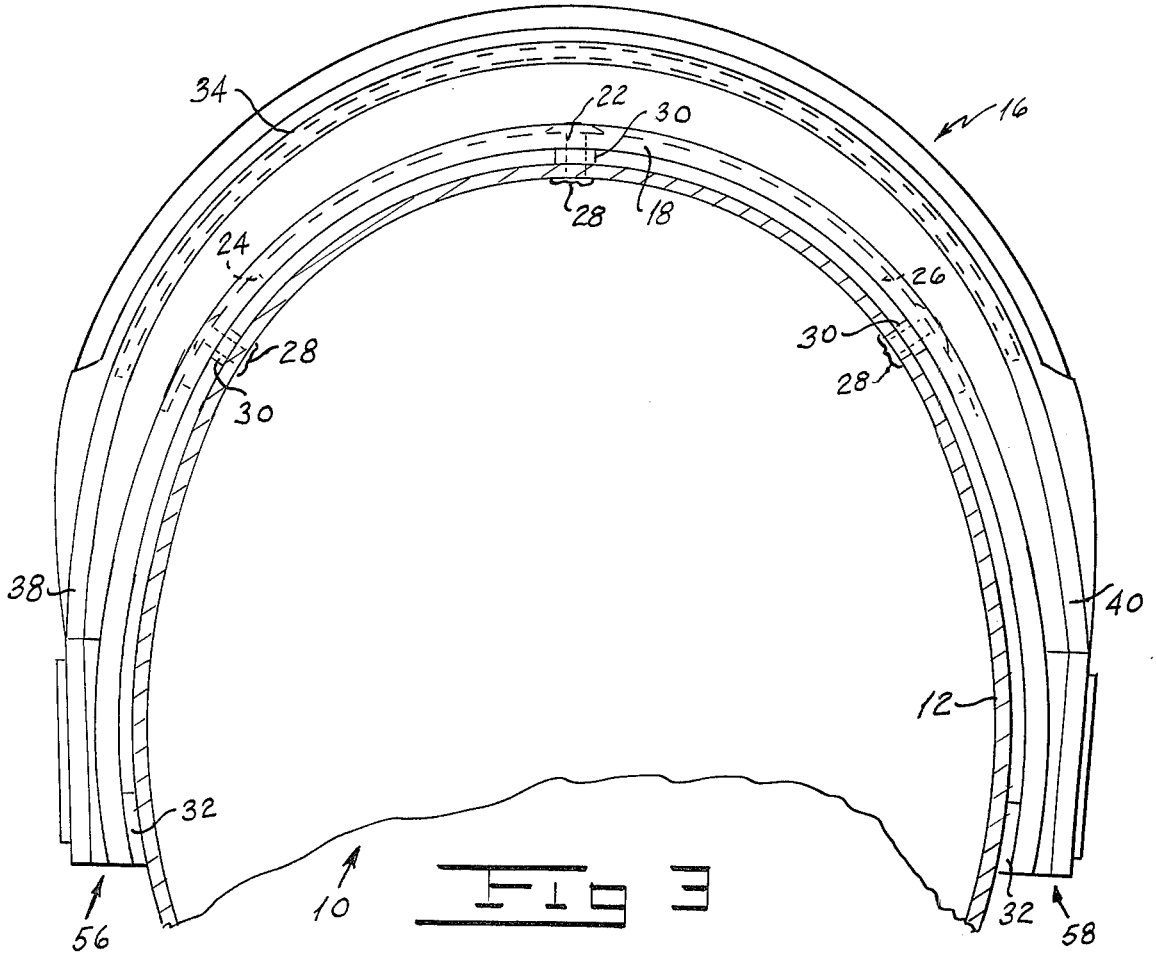
FIG. 3 is a bottom plan view of my flip-up visor assembly with the visor frame raised and showing its relationship to a helmet with which it is used.

Referring now to FIGS. 1 to 3 of the drawings, a helmet indicated generally by the reference character 10 with which my visor assembly can be used includes a shell 12 having a brow portion 14, which normally is positioned in front of the forehead of a wearer in use of the helmet. My flip-up visor assembly indicated generally by the reference character 16 includes a support band 18, which may be formed from metal or any suitable synthetic resin. The support band 18 is generally arcuate in shape and extends over somewhat more than 180°. The shape of the band is such that when assembled on a helmet the ends thereof will lie relatively closely adjacent to the outer surface of the smallest size helmet with which my visor assembly is to be used. Where the assembly is to be used with a relatively larger size helmet, the ends of the band 18 can be sprung outwardly in a manner to be described hereinbelow.

I form the outer surface of the band 18 with a channel 20 extending along the length of the band between points adjacent to the ends thereof. The band 18 includes a fastener receiving bore 22 generally centrally located along the length of the channel 20. A pair of slots 24 and 26 extend through the bottom of the channel 20 adjacent to the ends thereof. In applying the band 18 to the helmet shell 12, suitable fasteners such for example as rivets 28 are passed through the bore 22, the slots 24 and 26 and through the helmet shell 12 to secure the band to the shell. It is to be noted that the slots 24 and 26 permit the band 18 to be secured to shells 12 of various sizes. In securing the band 18 to the shell 12, I dispose respective spacers 30 around the rivets 28 or the like between the shell 12 and the band 18. In addition, pads 32 of a suitable material such for example as foam rubber or the like are located between the ends of the band 18 and the outer surface of the shell 12.

Referring now to FIGS. 2, 9 and 10, the visor lens frame 34 of my assembly 16 is provided with a central opening 36 extending between locations adjacent to the ends 38 and 40 of the frame 34. I form the frame 34 with a shoulder 41 extending around the frame 34 adjacent to the opening 36. The lens 42 of the visor assembly is adapted to be inserted into the frame 34 with the edge thereof resting against the shoulder 41. I provide means for releasably retaining the visor 42 in a position at which its edge rests against the shoulder 41. Respective locking plates 44, one of which is illustrated in FIG. 2 are supported on pivot pins 46 carried by the sides 38 and 40 of the frame 34. Each of the locking plates 44 is adapted to be pivoted between a release position and a locking position at which it enters into a receptacle 48 secured to or formed on the inner surface of each of the frame sides 38 and 40. In the position at which the plate 44 is in the receptacle 48, a portion thereof extends over the inner surface of the lens 42 adjacent to the edge thereof to retain the lens in position.

I form each of the plates 44 with a lug 50, which engages the edge of the receptacle 48 in the locked position of the plate. The lug 50 moreover facilitates withdrawal of the plate 44 from the receptacle 48. A detent 52 on the under side of the plate 44 is adapted to engage in a recess 54 in the inner surface of the side 40, for example, releasably to retain the plate in its lens locking position.

Figure 6:
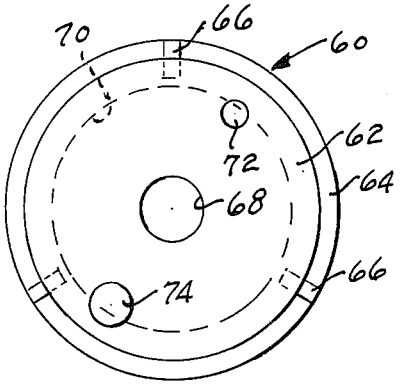
FIG. 6 is a plan view of the male pivoting, limit stop and releasable locking member of my flip-up visor assembly for a helmet.
Figure 8:
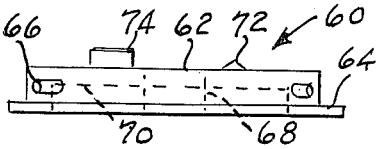
FIG. 8 is an elevation of the member illustrated in FIG. 6.

Associated with each of the sides 38 and 40 of the visor lens frame 34, I provide a respective pivotal supporting and limit stop assembly 56 or 58. Since both of the assemblies 56 and 58 are substantially identical, only the assembly 58 associated with the side 40 will be described in detail. Referring now to FIGS. 4, 6 and 8, the assembly 58 includes a male member indicated generally by the reference character 60 having a body 62 formed with a peripheral flange 64 and carrying a plurality of locating pins 66, which permit the member 60 to be assembled in a suitable opening in the side 50 of the lens frame 34. I form the member 60 with a central bore 68 adapted to receive a pivot pin in a manner to be described and with an outwardly opening recess 70. In addition, I form the inner surface of the body 62 with a detent 72 and with a limit stop pin 74.

Figure 5:
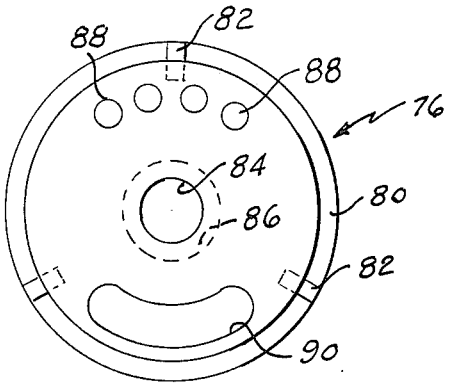
FIG. 5 is a plan view of the female pivoting, limit stop and releasable locking member of my flip-up visor assembly for a helmet.
Figure 7:
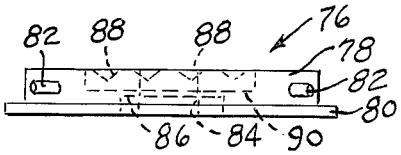
FIG. 7 is an elevation of the member illustrated in FIG. 5.

Referring now to FIGS. 4, 5 and 7, the assembly 58 includes a female member indicated generally by the reference character 76 having a body 78 provided with a peripheral flange 80 and a plurality of locating pins 82 which faciliate the assembly of the member 76 in a suitable opening formed in the enlarged end of the band 18 adjacent to the side 40 of the lens frame 34. I form the body 78 with a central pivot pin receiving bore 84 and with a pivot pin head receiving recess 86 in the inner surface thereof. In addition, the outer surface of the member 76 is formed with a plurality of spaced detent receiving recesses 88 for cooperation with the detent 72. An arcuate slot 90 is adapted to receive the pin 74 to limit the pivotal movement of the frame 40 with respect to the helmet shell 12.

After the members 60 and 76 have been assembled in the side 40 and in the end of the band 18 adjacent thereto, these parts are brought into associated relationship with the bores 68 and 82 aligned. With the parts in this position any suitable means, such for example as a rivet 92 is inserted in the bores with its head disposed in the recess 86. A spring washer 94 is assembled over the other end of the rivet which is then upset to retain the parts in assembled relationship. It will readily be appreciated that the spring 94 resiliently urges the detent 72 into engagement with the outer surface of the member 76, so that when the detent is aligned with the recess 88, it will drop therein and releasably retain the parts in that position. Preferably the recess 70 in the member 60 is covered by a cap 96 to which suitable identifying symbols or decorative material or the like can be applied.

In use of my flip-up visor assembly for a helmet, after the parts have been assembled on the shell 12 in the manner described above, the visor lens 42 can be moved between a lower limit position illustrated in full lines in FIG. 1 and an upper limit position illustrated in dot-dash-dash lines in FIG. 1, from a position generally in front of the wearer's face to a position clear of his face and above the helmet. Pin 74 cooperates with the slot 90 to prevent movement of the visor beyond its limit positions. The extreme end detent recesses 88 cooperate with the detent 72 releasably to hold the visor in either of these two positions. In addition, the visor may be moved to two intermediate positions indicated generally respectively by the dash line in FIG. 1 and by the dot-dash line in FIG. 1. The assembly is releasably held in these two positions by virtue of the cooperation of the detent 72 with the two intermediate detent receiving recesses 88 of the member 76. Preferably, I so arrange these two positions as to be 22° from the limit positions and 22° from each other. The visor frame 34 is readily and easily moved among any of its various positions merely by the pressure of the hand against the frame.

It will be seen that I have accomplished the objects of my invention. I have provided a flip-up visor assembly for a helmet. My visor is adapted to be moved among its various positions merely by the pressure of the hand on the visor frame. It is readily releasably retained in anyone of a plurality of positions. It does not require the manipulation of any knob or the like for the release of an auxiliary locking means. It is relatively simple in its construction and in its operation. It is inexpensive.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A flip-up visor assembly for a helmet comprising:

a. a visor;

b. a resilient band formed with a generally centrally located fastener-receiving bore and with a pair of fastener-receiving slots elongated in the direction of the length of the band and located between the ends of the band and said bore;

c. means for securing said band across the brow portion of said helmet; and d. means for mounting said visor on said band for pivotal movement between a lowered position at which the visor is in front of the upper portion of the wearer's face and a raised position clear of the wearer's face.

2. A flip-up visor assembly as in claim 1 including pads of resilient material between the ends of said band and said helmet.

3. A flip-up visor assembly as in claim 2 in which said band is formed with a fastener head receiving channel in the outer surface thereof.

4. A flip-up visor assembly for a helmet comprising:
a. a visor;
b. means for mounting said visor on said helmet for pivotal movement between a lowered position at which the visor is in front of the face and a raised position clear of the face, said mounting means including a first member carried by said helmet and a second member carried by said visor, said members having facing surfaces, a detent on one of said surfaces, spaced detent receiving means in the other surface, and resilient means urging said surfaces into engagement.

5. A flip-up visor assembly as in claim 4 including a limit stop pin extending outwardly from one of said surfaces and an elongated recess in the other surface for receiving said pin.

6. A flip-up visor assembly as in claim 5 in which said detent receiving recesses are disposed along the arc of a circle and in which said elongated recess is an arcuate slot.

7. A flip-up visor assembly for a helmet having a brow portion including in combination, a curved frame formed with a lens-receiving opening intermediate the ends thereof, a visor lens, means mounting said lens in said frame opening, a curved mounting band, means for securing said band to said helmet along the brow portion thereof at locations intermediate the ends of the band, means for assembling said frame on said mounting band with surfaces of said frame end facing surfaces of said band ends, said assembling means comprising respective pivot pins extending through said surfaces for mounting said frame for pivotal movement between said positions, one of said pivot pins permitting limited relative movement of its associated surfaces in the direction of the axis of said pin, a detent formed on one of said associated surfaces, spaced detent-receiving recesses formed in the other associated surface, said recesses being spaced by an angular distance equal to the angular distance between said lowered and raised positions of said frame, and resilient means for urging said associated surfaces into engagement releasably to hold said frame in said lowered and raised positions while permitting said frame to be moved between said position in response to a manual force applied to said frame.

8. A flip-up visor assembly as in claim 7 including a stop pin extending outwardly from one of said surfaces and an arcuate recess in the other surface for receiving said pin, said arcuate recess having an angular extent equal to angular distance between said lowered and raised positions of said frame to limit the movement of said frame to movement between said positions.

9. A flip-up visor assembly as in claim 8 in which said band securing means includes a fastener receiving bore located generally centrally of said band and a fastener receiving slot elongated in the direction of said band and located between said bore and an end of said band.

10. A flip-up visor assembly as in claim 9 including a plurality of spaced detent-receiving recesses located in said other associated surface between said first-named detent-receiving recesses.

11. A flip-up visor assembly as in claim 10 in which said lens mounting means comprises means for manually releasably mounting said lens on said frame.

12. A flip-up visor assembly as in claim 11 in which said lens mounting comprises means forming a shoulder on said frame around said opening adapted to receive the edge of said lens, a locking plate, means mounting said plate on the inside of said frame for movement between a locking position at which a portion thereof overlies the edge of said lens received by said shoulder and a release position at which said plate portion is free of said lens edge, and means for manually releasably retaining said plate in said locking position.

13. A flip-up visor assembly for a helmet comprising:
a. a visor lens;
b. a frame formed with a lens opening, said lens opening having a shoulder for receiving the edge of said lens;
c. a plate;
d. means for mounting said plate on said frame for pivotal movement between a locking position at which a portion thereof overlies the edge of said lens received by said shoulder to hold said lens in position on said frame and a release position at which said plate portion is free of said lens; and
e. means for releasably retaining said plate in said locking position.

14. A flip-up visor assembly as in claim 13 in which said releasable retaining means comprises a detent on one of the plate and frame surfaces and a detent-receiving recess on the other of said plate and frame surfaces.

15. A flip-up visor assembly as in claim 13 in which said plate has a pivoted end and a free end, and in which said frame is formed with a receptacle member having a slot for receiving the free end of said plate.

* * * * *